US005727937A

United States Patent [19]

Osthoff et al.

[11] Patent Number: 5,727,937

[45] Date of Patent: Mar. 17, 1998

[54] BURNER UNIT FOR THE SINGEING OF FLAT TEXTILE STRUCTURES

[75] Inventors: Walter Osthoff, Wuppertal; Rainer Ebbinghaus, Mönchengladbach, both of Germany

[73] Assignee: Osthoff Senge GmbH & Co. KG, Wuppertal, Germany

[21] Appl. No.: 649,120

[22] Filed: May 14, 1996

[30] Foreign Application Priority Data

May 15, 1995 [DE] Germany ..... 195 17 718.5

[51] Int. Cl.[6] ..... D02J 3/14

[52] U.S. Cl. ..... 431/158; 28/239; 28/174; 26/3

[58] Field of Search ..... 26/3; 28/239, 174; 431/158

[56] References Cited

U.S. PATENT DOCUMENTS 3,721,517 3/1973 Osthoff ..... 26/3
4,627,135 12/1986 Osthoff ..... 431/157

FOREIGN PATENT DOCUMENTS 0140181 5/1985 European Pat. Off. .
2213631 10/1973 Germany .

*Primary Examiner*—Carroll B. Dority
*Attorney, Agent, or Firm*—Martin A. Farber

[57] ABSTRACT

A burner unit for the singeing of flat textile structures and the like, in particular a burner unit for singeing machines having a combustion chamber and ramp stones forming one or more singe slits, the combustion chamber being fed from a gaseous mixture chamber via preferably two or more parallel burner slits. A ramp stone is arranged adjustably movable for changing the singe slit and/or the combustion chamber.

14 Claims, 9 Drawing Sheets

1
2
3
4
10
11
12
14
15
16
17
18
19
20
21
22
23
24
25
28
29
44
45
46
47
49
50
51
a
b
c
α
E
x
y
z 38
25
20
50
1
49
12
9
4
16
14
42
43
44
10
45
46
51
α
x
26
E
E
y
28
29
44
47
51
2
37
18
19
11
z
7
21
49
3
17
22
15
23
25
38
24
20
50

12
44
44
11
E
18
19
21
43
43
40
17
42
D
36
40
31
41
32
35
41
30
27
33
Z
1
27
34
29
25
35
28
D
25
X
39
26
E
9
39

15
49
12
16
14
E
2
y
49
11
15
4
α
51
51
47
50
50
46
45
10
22
21
19
18
44
44
18
19
21
22
20
20
54
Z
Z
17
24
26
39
39
27
27
29
28
28
29
x
9
37
38
38
53
8
7
52
V
6
25
25
5
23
E y
E
x
1
3
2
2
10
10
11
12
13
14
14
15
15
16
16
17
17
20
20
23
25
25
45
45
46
46
47
47
49
49
49'
50
50
51
51
α
α y
E
x
1
2
3
10
11
12
13
14
15
16
17
20
23
25
45
46
47
49
50
51

1
17
20
50
15
49
12
2
14
16
13
15
14
16
2
3
11
49
15
50
51
46
45
10
47
47
51
46
45
10
48
48
48
48
20
17
x
y
E
E
25
23
25

BURNER UNIT FOR THE SINGEING OF FLAT TEXTILE STRUCTURES

FIELD AND BACKGROUND OF THE INVENTION

The present invention relates to a burner unit for the singeing of flat textile structures or the like, in particular a burner unit for singeing machines having a combustion chamber and one or more ramp stones forming one or more singe slits, the combustion chamber being fed by preferably two or more parallel burner slits from a gas mixture chamber.

A singeing machine provided with such a burner unit is known from EPO 140 181. It assures a particularly high uniformity of the singeing flame over the entire operating width of the burner unit. Measures of optimal gas mixing and of quieted feed into the region of the burner slit contribute to this, in addition to a cleaning of the burning gas. The ramp stones which, arranged in front of the slit, are also developed as to avoid disturbing influences on the desired stable flame. This is concretely established by a sequence of wide and narrow regions in front of the flame emergence place of the singe slit.

From Federal Republic of Germany Patent 22 13 631, it is furthermore known to provide the singe slit of a singeing machine with a course which differs from linear gas-feed/flame-formation; the singe slit is bent upward by about 30° with respect to the horizontal and continues upward into a convexly curved surface of the ramp stone. In this way, the singeing flame, supported by the suction stream of a suction bell is deflected upward. The flame formed in this way exerts a singeing action on the textile structure pulled over the edge of a table. This very gentle singeing is particularly suitable for the leveling of protruding fibers and for the repair of fabrics with broken filaments. The table can be displaced and locked horizontally and vertically with respect to the adjustment of the closeness of the singeing flame.

SUMMARY OF THE INVENTION

The object of the present invention is further to develop a burner unit of this type for singeing machines with respect to the forming and direction of the singeing flame in such a manner that the possibilities of individual adaptation to the most different circumstances which occur in practice are expanded by simple means.

In order to achieve this object, the invention provides that a ramp stone be adjustably movable in order to change the singe slit and/or the combustion chamber. In this way, the mouth of the singe slit can be shaped with respect to its "lips". This refers, with respect to displacement, not solely to the width of the slit but also to the cross-sectional shape of the combustion chamber which is determined primarily by the ramp stones. Thus, at the same time, the slit width of the narrow channels can accordingly be changed. This additional parameter considerably enriches the desired variation. Furthermore, the invention provides that the ramp stone to mounted on a ramp-stone support and that the ramp-stone support be movable for the displacement of the ramp stone. In this way, the well-proven replaceable connection between ramp stone and ramp-stone support can be retained; only the directly supporting region is displaceable towards the burner unit and lockable. Advantageously, one proceeds also here in the manner that the ramp stone is held by clamp on the ramp-stone support. Specifically, the displaceability is such that the ramp-stone support is pivotally mounted in front of the combustion chamber as seen in the direction of flow. The corresponding region is not only favorable for the arrangement of the means forming the pivot joint but also brings about an arrangement which is comparable to a sight leaf; the ramp stone moves in front of the burner slit or slits, constricting the singe slit to a greater or lesser extent. For optimizing, both ramp stones can be rotatably mounted in the manner described. With this type of burner unit of a singeing machine in which the gas mixing chamber is surrounded by a burner body which consists of two profiled parts of approximately U-shape in cross section, it is advantageous, with respect to the said pivot mounting, for one profiled part to have a pivot recess into which a pivot-joint projection of the ramp-stone support engages. The corresponding pivot-joint connection can extend practically over the entire operating width, so that the slit width of the singe slit is the same everywhere. Furthermore, it is the pivot-joint projection can be developed in the manner of a ledge. Such a ledge can be pushed overhead. With respect to the ledge which forms the pivot, it is furthermore proposed that it have a recess or flattening in the shape of a circular segment. This means that its head is cut back so that less "meat" is lost on the side of the profiled part. A sufficiently stable wall is retained towards the mixture distributing ledge. Accordingly, the pivot recess is adapted to the cross section of the ledge by a substantially straight bottom. Furthermore, the invention proposes that the singe slit be developed flush with the combustion chamber. Taking into account the path of the goods in front thereof, the singeing flame strikes at right angles against the goods which are conducted between two guide rolls. On the other hand, it may, however, be advantageous in certain cases for the singe slit to be developed at an angle to the combustion chamber. This opens up a more grazing direction of the singeing flame and thus a further possibility of very fine variation, also from the aspect of traveling in the direction of movement of the goods or opposite same. In order to obtain a so-called double-slit burner unit, it is therefore favorable for two ramp stones to be arranged opposite each other, forming the singe slit and the combustion chamber between each other, the front surface of the ramp stones facing the textile structure extending at an oblique angle to the linear direction of the combustion chamber. Furthermore, a development can be employed in which the ramp stones are developed protruding a different distance in the region of the singe slit. In this way, the alignment of the slit can be obtained with utilization of the protrusion of the one or other ramp stone. Finally, still another advantageous feature of the invention is that the second ramp stone in the direction of travel of the goods is developed extending backwards. Finally, there can also be used a development in which three ramp stones are present, a central ramp stone being stationary, they leaving the singe slits between them. With accordingly displaceability on both sides of the ramp stones, a shape of the singe slit which is independent from one another can be obtained.

BRIEF DESCRIPTION OF THE DRAWINGS

With the above and other objects and other advantages in view, the present invention will become more clearly understood in connection with the detailed description of preferred embodiments, when considered with the accompanying drawings of which:

FIG. 7 is a burner unit in accordance with a fourth embodiment, the two singe slits being directed obliquely opposite each other;

DETAILED DESCRIPTION OF THE PREFERRED EMBODIMENTS

The burner unit 1 of all embodiments shown including variants is a part of a singeing machine, which is not itself shown, such as known for instance from the not previously published German Utility Model Application 29 505 376.

The burner unit 1 can be displaced from a turned-off position into an operating position in the manner that its suction slit 2 is turned for singeing into the region close to a flat textile structure 3. The singeing flame 4 emerging from the singe slit 2 eliminates the fiber ends protruding from the center of the thread or flat textile structure 3.

Figure 4:
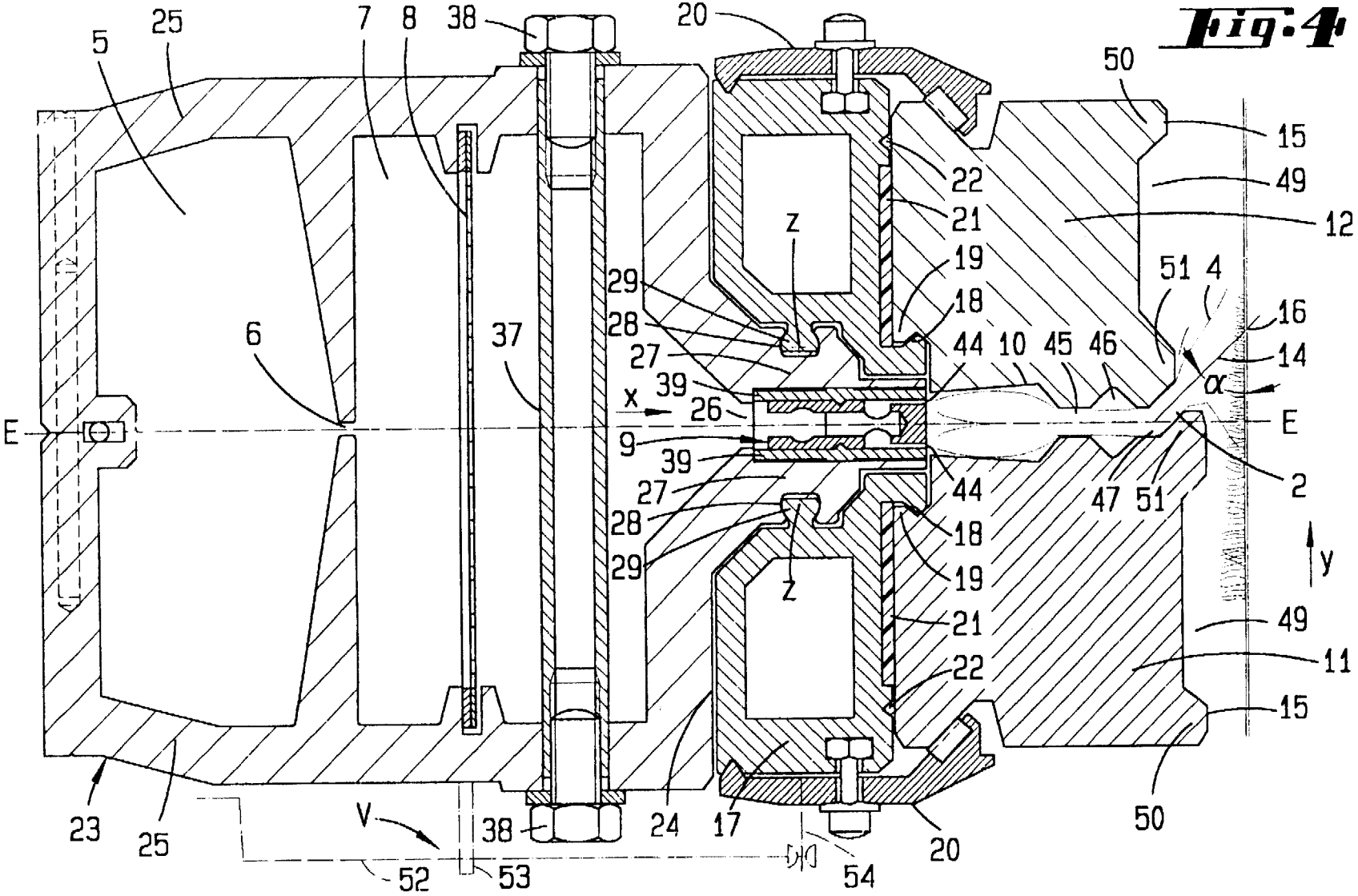
FIG. 4 is a complete cross section through this burner unit further developed in the manner that both ramp-stone supports are rotatably mounted, as variant of the first embodiment.

The burner unit 1, as a general rule, has a width of several meters. At its ends, a gaseous mixture is introduced via feed lines into a distributor chamber 5 which can be clearly noted from the cross-sectional showing (FIG. 4). Via an adjoining constriction step 6 in the direction of emergence (arrow x), the gaseous mixture emerges with increased velocity of flow out of the distributing chamber 5 and enters into an adjoining gaseous mixture chamber 7 in which it expands. Here, the mixture quiets down, passing through a filter 8 on which solid impurities are separated out.

From the gaseous mixture chamber 7, the gaseous mixture flows through a horizontal gaseous mixture distributing ledge 9 into a combustion chamber 10. The corresponding passage takes place with uniform distribution over the entire width of the burner unit 1.

Two ramp stones 11, 12 arranged alongside of each other are determinative for the shape of the combustion chamber 10. The stones extend in the direction of travel of the goods (arrow y) lying one behind the other (see FIG. 4). The ramp stone at the bottom here bears the reference numeral 11.

As from the third embodiment, a third ramp stone designated 13 is interposed between said two ramp stones 11, 12, so that a double-slit burner unit is present.

Adjoining each combustion chamber 10 is a singe slit 2.

In accordance with the fifth and sixth embodiments, the singe slit 2 extends aligned with the combustion chamber 10. The center line 14 of the flame-jet there is perpendicular to the flat textile structure 3 passing with high speed in the direction of travel of the goods (arrow x) in front of the front surface 15 of the burner unit 1. The corresponding development is also conceivable for a burner unit 1 having only one singe slit 2. On the other hand, the double-slit version shown has the advantage of a spaced singeing and therefore one which takes place in two steps. The other embodiments show an arrangement of the said slit or slits 2 directed at an angle to the combustion chamber 10.

In accordance with the first embodiment, the center line 14 of the flame jet assumes a position oblique to the plane of the flat textile structure 3. It (14) forms an acute angle alpha of 45° with respect to the section of the flat structure 3 lying in front of the place of impingement 16.

The same applies also to the solution in accordance with the third embodiment, namely the double-slit version. The reference numerals have been applied accordingly.

Figure 5:
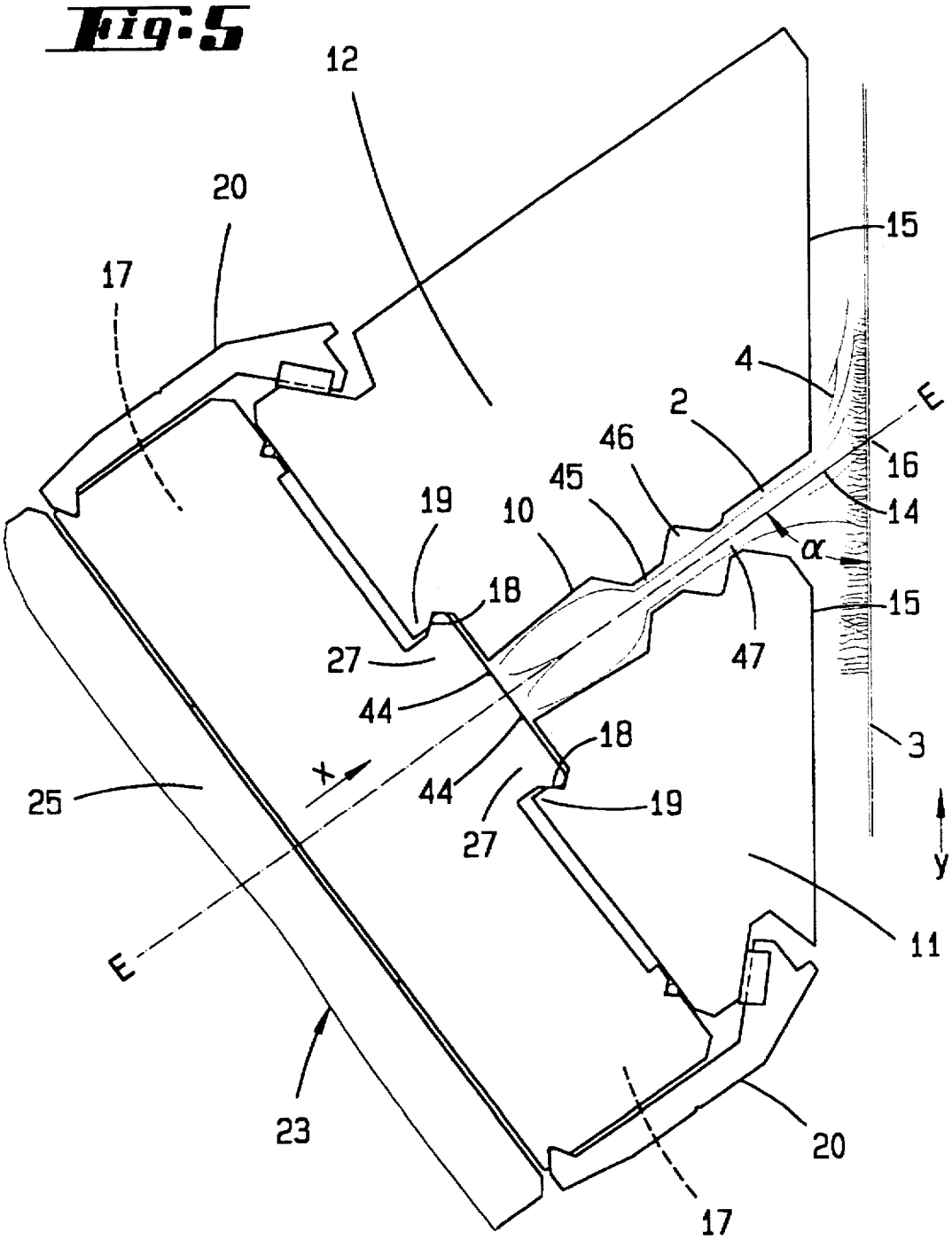
FIG. 5 is a diagrammatic side view of the burner unit in accordance with the second embodiment.

A solution which employs the desired oblique course without, however, having to effect a change in direction between combustion chamber 10 and singe slit 2 consists therein that the two ramp stones 11, 12 which form the singe slit 2 and the combustion chamber 10 between them are developed with their entire front surface 15 in a corresponding oblique angle and the burner unit 1 itself is tilted into the oblique position, as can be noted from FIG. 5. In that case, also, the center line 14 of the flame jet forms the acute angle alpha of 45° with the linear extension of combustion chamber 10 and singe slit 2.

The fourth embodiment shows a mixed form of the flame-jet direction on a two-slit version. The lower suction slit 2 extends in opposite direction at an angle of 45° to the plane of the flat textile structure 3. In this way, there is produced at the bottom a singeing which is directed in direction opposite to the direction of travel of the goods (arrow x) and at the upper singe slit 2 a substantially after-acting second, grazing singeing. Since this takes place locally and in a certain sense also spaced in time, a concentration of heat onto a single point is avoided despite the double singeing. Here, an individual manner of treatment for given materials can be obtained with rather simple means.

Figure 1:
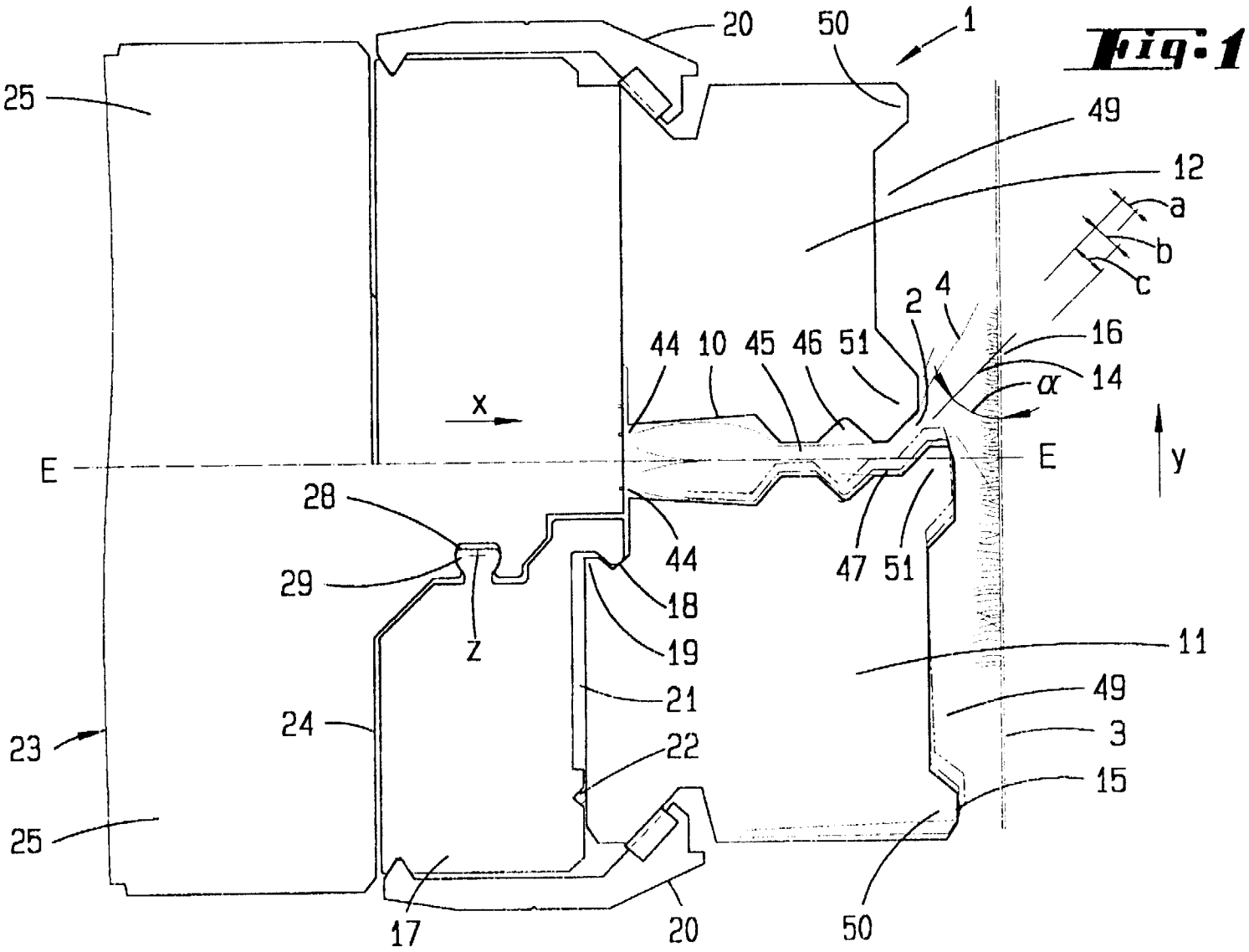
FIG. 1 shows the burner unit in a substantially diagrammatic side view, in accordance with the first embodiment.

A burner modification which goes further in this direction is described in the following individual remarks:

The corresponding basic principle consists therein that a ramp stone is arranged in adjustable movable manner in order to change the singe slit 2 and/or the combustion chamber 10. In this way, the width of the slit can be varied. This can be done in infinitely variable manner. Although, in FIG. 1, a few steps a, b, c, indicated in the region of the mouth of the slit 2 have been entered as stepwise jumps, of the order of magnitude of, for instance 3 mm, 5 mm, and 6 mm, narrower or wider steps can also be selected.

The corresponding adjustment steps are indicated on the ramp stone 11 in dash-dot and dash-dot dotted lines aside from one position which appears in solid line.

FIG. 4 indicates a variant in which also the adjacent ramp stone, designated 12, is arranged for adjustable movement in the same manner.

Figure 2:
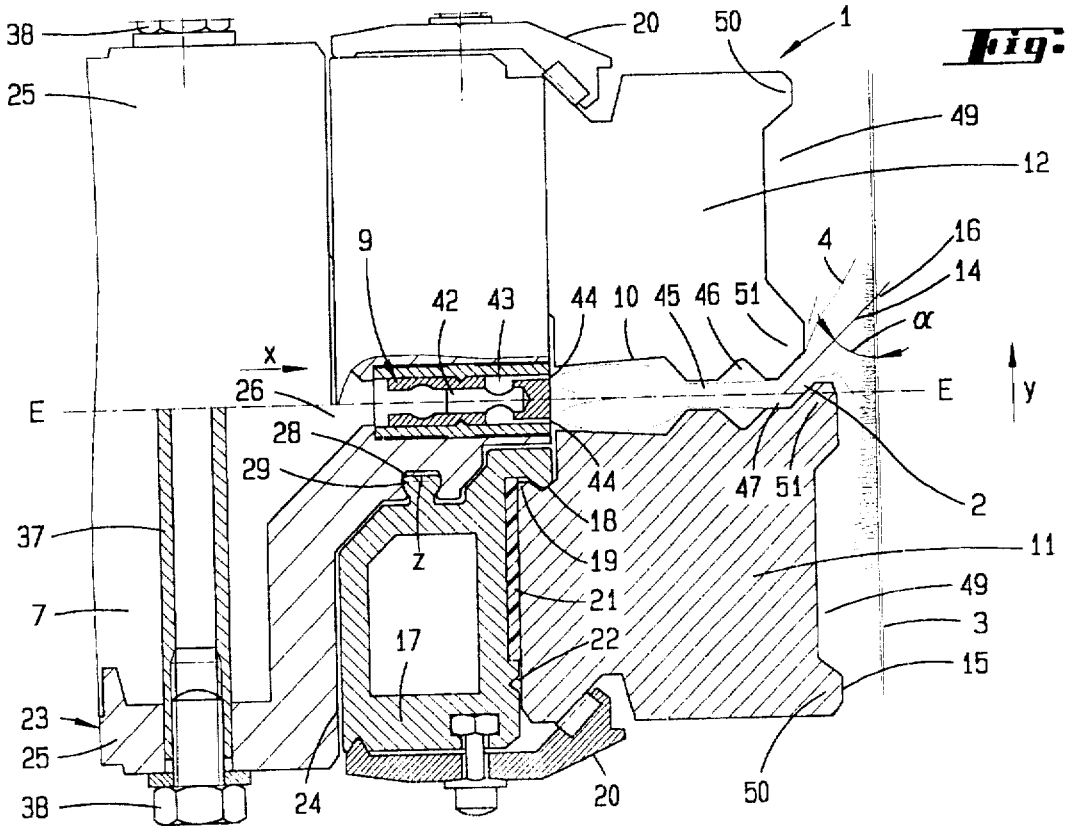
FIG. 2 shows the same unit in approximately a half section.
Figure 3:
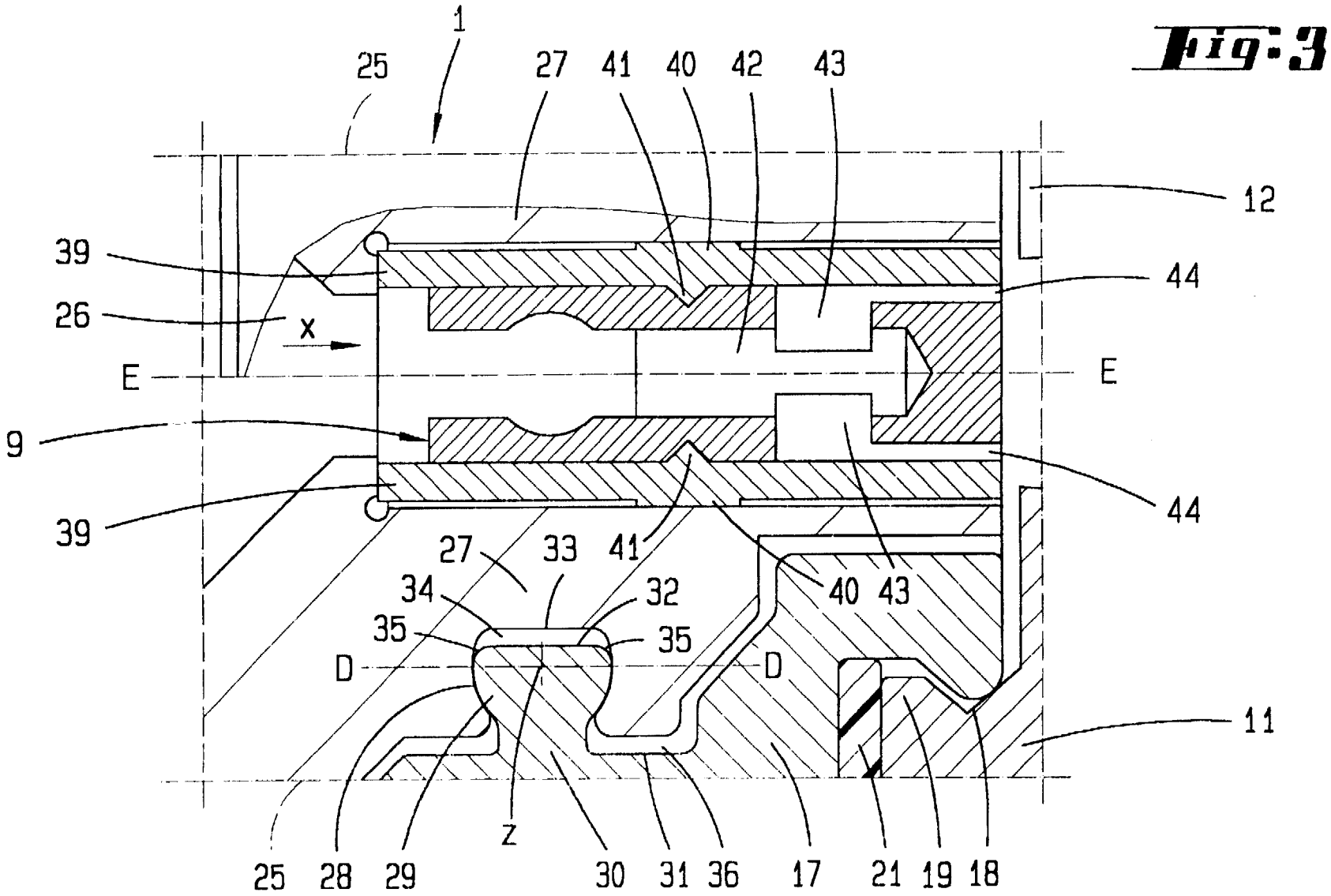
FIG. 3 is an enlarged showing as compared with FIG. 2 of the region of the mixture distributing ledge and of the pivot mounting of the ramp-stone support.

The means for this adjustment can be noted in FIGS. 2 and 4, and with particular clarity in FIG. 3. As can be seen, the ramp stone 11 which results in the variation of the slot width of the singe slit 2, etc. is held on a ramp-stone support 17. This is done by means of an undercut 18, a ledge-like projection 19 of the ramp stone and remote from this spot by a clamp 20. These means are described in the prior art publication from which the present invention proceeds and are applied in analogous manner here. Between this fastening place which lies in the rear of the ramp stone 11 there are heat-insulating means 21 and an elastic intermediate layer 22. Furthermore, cooling water can circulate within the ramp-stone support 17.

The ramp support 17 is itself in movable association with a burner body 23 which practically forms the housing of the burner unit 1. The displaceability results via a pivot bearing. Its geometrical axis z extends parallel in space to and in the vicinity of the centrally located gaseous mixture distributor ledge 9. To this extent, the bearing place, seen in the direction of flow of the gaseous mixture, is located clearly in front of the combustion chamber 10. The direction of flow is identical to the direction of emergence designated x.

For the arrangement of the ramp-stone support or supports 17 as close as possible to the combustion chamber, the head end of the burner body 23 leaves sufficiently large corner niches 24 on both sides of the horizontal longitudinal center plane E—E of the burner part 1. Two profiled parts 25 of essentially U-shaped cross section which surround the corresponding burner housing 23 with their U-opening directed opposite each other are shaped correspondingly and continue into wall sections 27 with due consideration of a funnel or notch-valley joint 26 which narrows down towards the gaseous mixture distributor ledge 9. On the outer side se these wall sections 27 of the profiled parts 25, there is in each case a pivot recess 28. Into it, there engages a pivot-joint projection 29 of the ramp support 17. The insertion can be effected through an open end of the pivot recess 28.

The pivot-joint projection 29 consists of a ledge-like development on the ramp support 17. The part producing the articulation is predominantly of circular cross section, namely cylindrical, except for a narrow support foot 30 to the corresponding narrow wall 31 of the ramp-stone support 17. The further exception consists of a recess or flattening 32 of the ledge having the shape of a circular segment. The recess lies outside the diameter D—D of the pivot-joint projection 29 which extends parallel to the narrow wall 31.

The pivot recess 28 is also adapted with respect to the flattening 32, to the cross section of the ledge and, accordingly, provided with a substantially straight bottom 33. Between flattening 32 and bottom 33, there remains a free space 34 which is necessary for the displaceability of the ramp stone or stones 11, 12. In order to avoid a planing action between the interrupted cylindrical outer surface of the ledge and the pivot recess 28, these transitions are convexly rounded transversely. The transverse roundings are designated 35. A slot 36 which permits the desired mobility of the ramp-stone support 17 is also present between the said narrow wall 31 and the opposite outer side of the wall section 27.

The profiled ledges 25 which form the burner body 23 are connected by means a clamping sleeve 37 which passes across the gaseous mixture chamber 7 and clamping sleeve screws 38 which act on the end on the outside.

The gaseous mixture distributor ledge 9 which is clamped in this way between the wall sections 27 is backed by guide ledges 39 on the inner side of the wall sections 27, without however lying with full surface thereon. Rather, the corresponding application is limited to the region of an outside thickening 40, which exerts a supporting action in the center. On the inside of the zone of thickening each of the guide ledges has a longitudinally extending passage ridge 41 which engages in position-securing fashion in a mating groove of corresponding shape on the outside of the distributing ledge 9.

Within the gaseous mixture distributing ledge 9 which can be provided with a flow equalizer (not shown), the stream of gas is split up. The inflow takes place via a number of centrally located, closely adjacent blind holes 42. The latter end in front of the narrow side of the distributor plate 9 lying in direction of flow. Transverse to the blind holes 42, a plurality of which are present, there extends, in the form of penetrations on the outer side in each case a longitudinal groove 43 which is open towards both broad sides of the distributor ledge 9. The longitudinal grooves act to equalize the pressure and are in fluid communication with burner slits 47 which produce a forking of the stream of gaseous mixture. Via these two rather narrow, parallel burner slits which result from the corresponding forking of the path, the gaseous mixture enters into the combustion chamber 10.

The combustion chamber 10 has a relatively long widened region at the start in the direction x, which region then passes into a short, narrow region 45. Adjoining this, the ramp stone 11, 12, 13, which are developed with silhouette symmetry in this respect, again form a widened region 46 so that approximately the same width as in 10, but of clearly reduced length, in order thereupon to again pass via a narrow region 47 into the beginning of the singe slit 2, which is of the same width as 45.

In accordance with the fifth and sixth embodiments narrow region 47 and singe slit 2 are practically identical. The mouth of the singe slit is beveled in all cases on the inner-edge side. The bevel amounts to about 45°. Also in all other embodiments the mouth is so widened in funnel shape in cross section, also in cases in which the ramp stones are developed protruding different distances in the region of the singe slit 2. With due consideration of the direction of travel of the goods (arrow y), the second ramp stone 12 is developed protruding backward in accordance with the first and third embodiments.

In accordance with the fifth embodiment, the ramp stones 11, 12 and 13 terminate practically at the same distance from the vertical extent of the flat textile structure 3. The same development is selected also with respect to the same variant of the fifth embodiment, only that, in that case, the initial portion of the combustion chamber 10 has a saw-tooth-like wall structure, designated 48, which produces an eddying of the foot of the flame in this region. The profiling shown extends over the entire width of the burner unit.

In accordance with the third embodiment, the ramp stone 11 protrudes forward, and the third ramp stone 13 present between it and the ramp stone 12 does so also. They protrude to the same extent.

From the showing of the fourth embodiment it is clear that the intermediate ramp stone 13 which acts in flame-jet diverging manner alone assumes an exposed position with respect to the two adjacent ramp stones 11, 12, which themselves protrude in the same vertical plane.

In all cases the central ramp stone 13 is stationary.

The ramp stones forming the front surface 15 of the burner unit 1 are drawn inward in trough-like manner at a distance from the edge. This trough-like, approximately trapezoidal cross-sectional structure forms an open chamber 49 which widens toward the flat textile structure 3 and is limited by edge ribs 50 and 51. With corresponding direction of the flame the heat is held here somewhat longer. The free ends of the edge ribs 50, 51 are also beveled.

Figure 6:
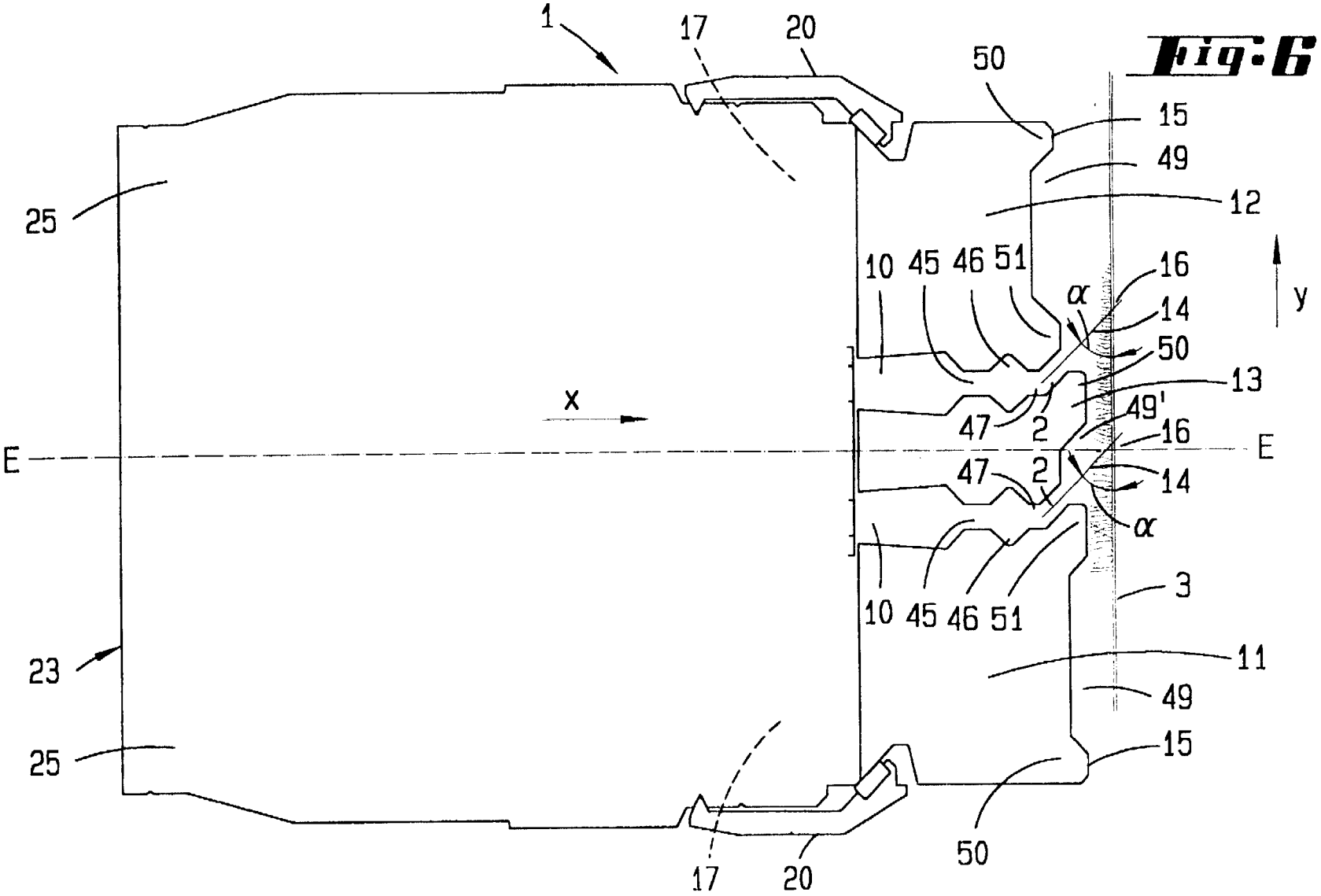
FIG. 6 is a similar view in accordance with the third embodiment developed as double-slit burner unit, both singe slits being directed at an oblique angle in the same direction.
Figure 1:
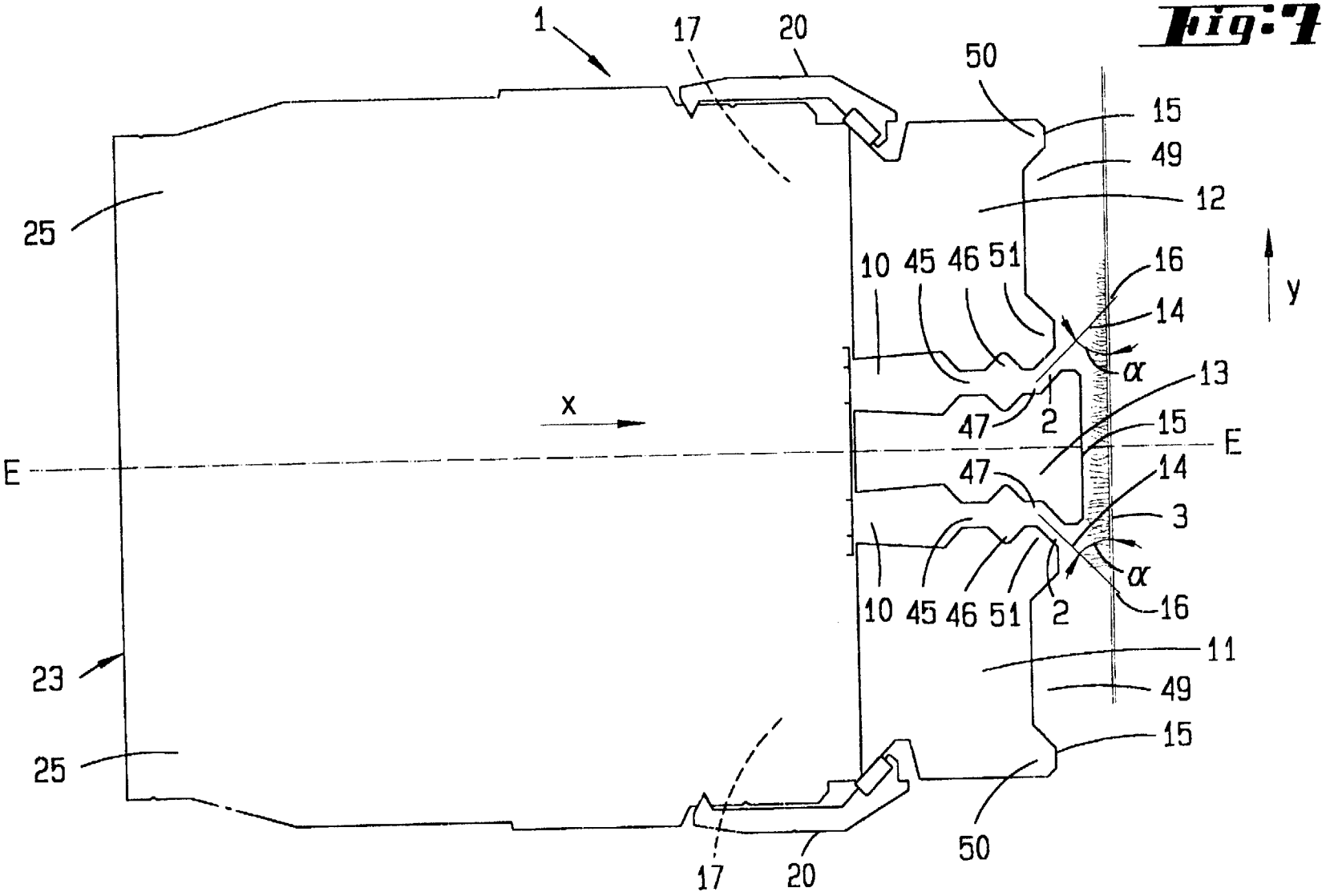
Figure 8:
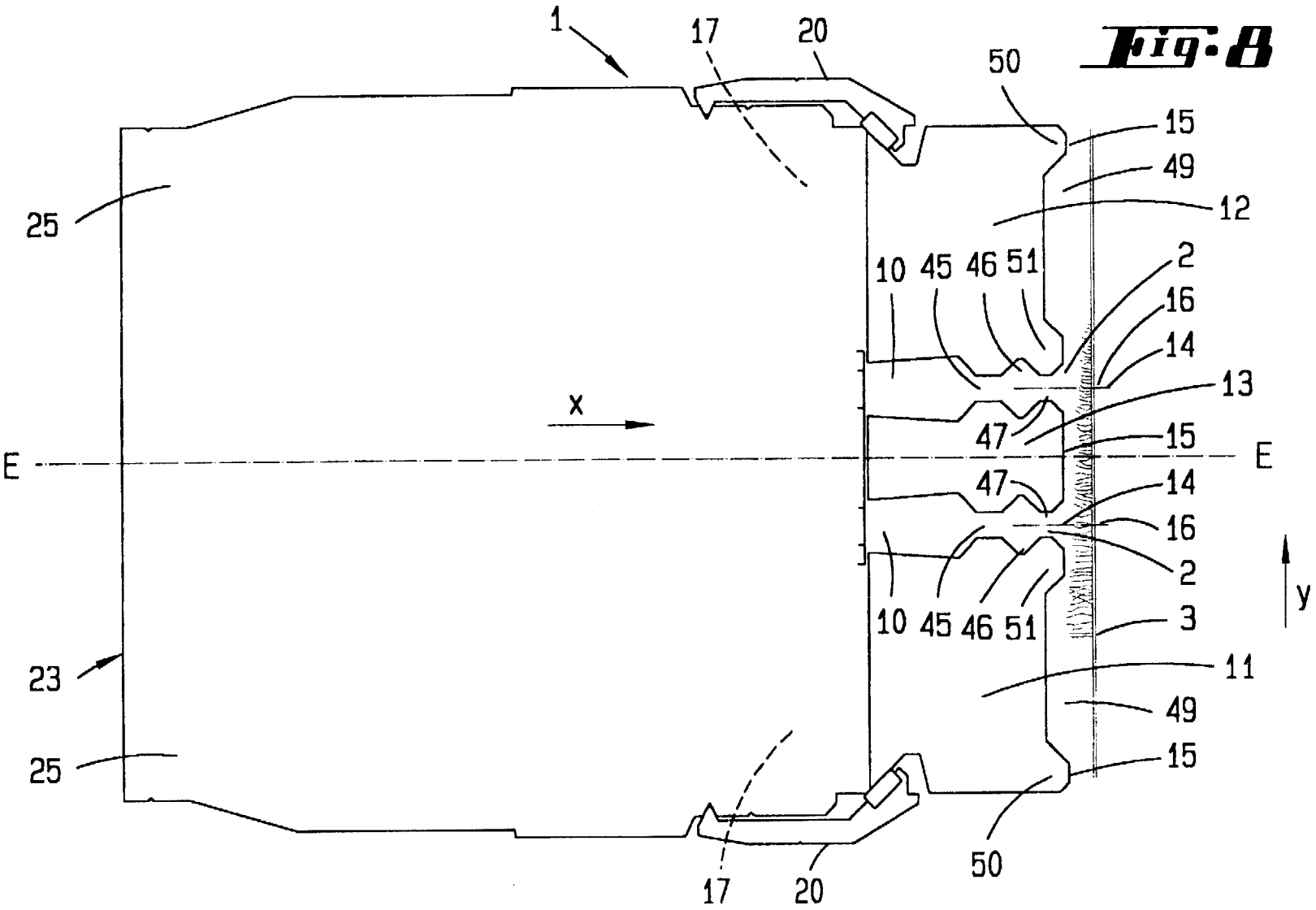
FIG. 8 shows a burner unit in accordance with a fifth embodiment, also developed as double-slit burner unit, in which, however, the singe slits are so directed that they strike the passing web of goods at a right angle.
Figure 9:
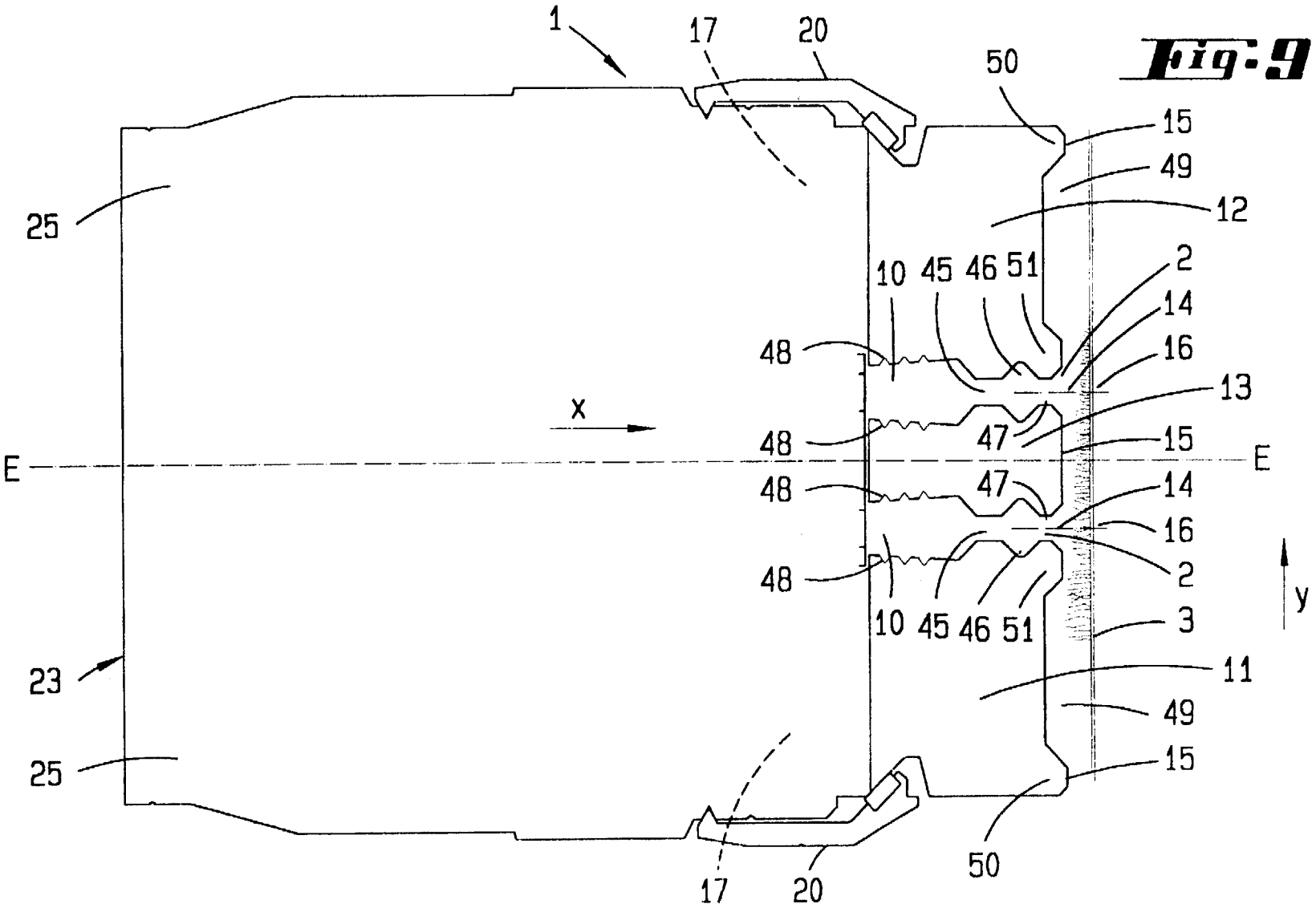
FIG. 9 is a variant thereof, with a different silhouette of the combustion chamber.

With the exception of the version shown in the third embodiment, the third ramp stones 13 do not have a chamber 49 limited on its edge on both sides, at most one formed in combination with an adjacent edge, seated at the bottom in FIG. 6, of the first ramp stone 11. The corresponding chamber coming from two ramp stones is designated 49'.

With regard, now, to the second embodiment, such corresponding chambers are entirely absent. As a result of the 45° arrangement of the plane E—E of the burner unit 1, the ramp stone 12 which lies in the direction of travel of the goods (arrow y) is further in front, referred to a vertical cross-sectional plane E—E, than the ramp stone 11 located below it. The reference numerals are otherwise applied by analogy. With respect to the displacement of one or the other or both ramp stones, the detailed remarks made above apply by analogy.

A device V, sketched in FIG. 4, serves as displacement handle. It comprises a crank-actuatable screw spindle 52 which passes through a stationary bearing lug 53 which has a corresponding mating thread. With its free end, the screw spindle 52 engages on a arm 54 which extends transversely to the axis of the screw spindle. The arm acts as control arm rigidly connected with the ramp-stone support 17 which is mounted for swinging via z. The action between screw spindle 52 and the free end of the control arm takes into account the necessary joint mobility, for instance via spheres and slots.

With shortening spindle stroke, the ramp stone 11 is swung away from the plane E—E via ramp-stone support 17, with enlargement of the singe slit 2 and of the combustion chamber 10. The same applies in case of the joint mobility of the other ramp stone 12. In this way, a singeing which is excellently adapted to the particular case of treatment can be obtained.

In addition to the two singe slits 2 shown, three, four and more such slits can also be provided; the same is true with respect to the burner slits 44, that two and more distributor ledges 9 are clamped between the profiled parts 25, of course with adaptation of the clamping regions of the burner body 23.

We claim:

1. A burner unit for the singeing of a flat textile structure and the like, in particular a burner unit for singeing machines having a combustion chamber and ramp stones forming at least one singe slit, the combustion chamber being fed from a gaseous mixture chamber via preferably at least two parallel burner slits, wherein one of said ramp stones is arranged adjustably movable for changing the singe slit and/or the combustion chamber.

2. A burner unit according to claim 1, wherein said one ramp stone is held on a ramp-stone support, and the ramp-stone support is movable for the displacement of the ramp stone.

3. A burner unit according to claim 2, wherein the one ramp stone is clamped on the ramp-stone support.

4. A burner unit according to claim 2, wherein the ramp-stone support is pivotally mounted in back of the combustion chamber in a direction of flow.

5. A burner unit according to claim 1, in which the gaseous mixture chamber is formed by a burner body which comprises two profiled parts which are approximately U-shaped in cross section, and wherein one of said profiled parts has a pivot recess into which a pivot-joint projection of the ramp-stone support engages.

6. A burner unit according to claim 5, wherein the pivot-joint projection is formed as a ledge.

7. A burner unit according to claim 6, wherein the ledge has the shape of a circular segment including a flattening.

8. A burner unit according to claim 6, wherein the pivot recess is adapted to the cross section of the ledge with a substantially flat bottom.

9. A burner unit according to claim 1, wherein the singe slit is developed aligned with the combustion chamber.

10. A burner unit according to claim 1, wherein the singe slit is developed at an angle to the combustion chamber.

11. A burner unit according to claim 1, wherein two of said ramp stones are arranged opposite each other, forming between each other the singe slit and the combustion chamber, an end surface of each of the two ramp stones which faces the textile structure extending at an oblique angle to a linear dimension of the combustion chamber.

12. A burner unit according to claim 1, wherein the ramp stones are formed protruding a different distance in a direction of an outlet of the singe slit.

13. A burner unit according to claim 1, wherein a second of the second ramp stones in a direction of travel of the textile structure is formed protruding backward.

14. A burner unit according to claim 1, wherein there are three of said ramp stones, a central one of the ramp stones being arranged fixed in position, leaving slits between the three ramp stones.

* * * * *